United States Patent [19]

Ragen

[11] 4,428,694

[45] Jan. 31, 1984

[54] ROTARY PRINTING DEVICE WITH IDENTIFYING MEANS AND METHOD AND APPARATUS FOR IN SITU IDENTIFICATION

[75] Inventor: Robert A. Ragen, Hayward, Calif.

[73] Assignee: Xerox Corporation, Stamford, Conn.

[21] Appl. No.: 446,114

[22] Filed: Dec. 2, 1982

Related U.S. Application Data

[63] Continuation of Ser. No. 233,538, Feb. 11, 1981, abandoned.

[51] Int. Cl.[3] ..... B41J 1/30

[52] U.S. Cl. ..... 400/144.2; 400/175

[58] Field of Search ..... 400/70, 73, 141.1, 143, 400/144, 144.1, 144.2, 144.3, 175

[56] References Cited

U.S. PATENT DOCUMENTS 4,074,798 2/1978 Berger ..... 400/144.3

4,264,220 4/1981 Okcuoglu ..... 400/144.2

FOREIGN PATENT DOCUMENTS 621597 8/1978 U.S.S.R. ..... 400/144.3

OTHER PUBLICATIONS

*IBM Tech. Disc. Bulletin,* R. D. Mathews et al., vol. 22, No. 11, Apr. 1980, pp. 4791–4792.

*Primary Examiner*—Paul T. Sewell

*Attorney, Agent, or Firm*—Serge Abend

[57] ABSTRACT

A novel rotary printing device, such as a daisy-type printwheel, for use in an impact printer, having identifying means thereon. In one form, plural protrusions, extending axially outwardly from the printing device, are provided and the angle between the protrusions serves the dual function of identifying the print element characteristics and identifying the reference position of the printing device for "arming" the printer with the information. In another form, a single protrusion is provided solely for identifying the reference position. A method and apparatus for in situ identification of the novel rotary printing device also forms a part of the instant invention.

22 Claims, 10 Drawing Figures

ROTARY PRINTING DEVICE WITH IDENTIFYING MEANS AND METHOD AND APPARATUS FOR IN SITU IDENTIFICATION

This is a continuation of application Ser. No. 233,538, filed Feb. 11, 1981, abandoned.

This invention relates to an improved rotary printing device, such as a daisy-type printwheel or a cup-shaped printing element, for use in an impact printer. The printwheel is provided with identification features thereon which, in one form, serve to locate a "home" or reference position. In an another form, the identification features provide to the printer, in addition to locating a "home" position, information regarding the font style, language, pitch, point size and other characteristics. This information enables the printer to select the desired characters, to increment the carriage by the correct amount, and to impact the printwheel at the proper energy level. A method and apparatus for in situ identification of the rotary printing device is also comprehended in this invention.

In impact printers utilizing daisy-type printwheels or printcups, i.e. printing devices having a plurality of radially extending spokes or petals each bearing one or more characters thereon, it is desirable to readily substitute one print element for another in order to simply and quickly change the printed output. To this end, the mechanics of removing one device and replacing it with another have been greatly simplified. For example, the printwheel shown in U.S. Pat. No. 4,037,706 (assigned to the instant assignee) is provided with a handling cap. In assignee's companion U.S. Pat. No. 3,954,163 a similar printwheel provided with a handling cap is shown mounted in a printer. Another approach to simplified printwheel manipulation is shown in U.S. Pat. Nos. 4,127,335 and 4,209,262 (both also assigned to the instant assignee) wherein the printwheels are cartridge-loaded and the printer is provided with a suitable mechanism to accept it.

Beyond the mere mechanics of quickly and easily substituting one printing device with another, it is desirable to "arm" today's intelligent printers with necessary information about the loaded printwheel or printcup in order that the printer will know the location of each character, the proper impact energy level to be applied to each character, and the lateral distance by which the printer carriage must be moved. Printing device identification to the printer may be provided directly by the user through a keyboard entry or the printer may "read" this information directly from the loaded device. Once the identifying information has been received, the printer will make the necessary control adjustments. This may be accomplished as taught in U.S. Pat. No. 4,074,798 (also assigned to the instant assignee), by any number of embodiments of read-only memory, in the form of optical or magnetic indicia, arranged in a circular manner on the printwheel hub. Alternatively, Xerox Disclosure Journal, Vol. 1, Nos. 9/10, September/October 1976, p. 25 discusses, in general terms, the desirability of placing a code upon each petal to control the impact force for that character. Also, IBM Technical Disclosure Bulletin, Vol. 22, No. 11, April 1980 teaches the use of optical indicia placed upon the end portion of printwheel petals for identifying the printwheel font.

It is also necessary, when loading a printing device on the printer carriage, to provide some means for locating a reference position in order that, upon the operator's selection of a character on the keyboard, the spoke bearing that character will be aligned with the hammer for impaction. This is required since each character is allocated a unique number representing its position relative to the reference position. An optical arrangement for zeroing in, or locating, the "home" position of a printwheel, or a printcup, in an impact printer is taught in U.S. Pat. No. 3,651,916. Therein, there is disclosed a printwheel having a peripheral aperture defined by the absence of print petals. A photoelectric cell and cooperating light source identify the home position when the aperture passes between the light source and sensor.

Several mechanical "home" positioning configurations are taught in the aforementioned U.S. Pat. Nos. 4,037,706 and 4,127,335, and also in U.S. Pat. No. 4,161,373. In each, the printwheel is provided with an opening in the form of a keyway into which a locating key is positioned, upon mounting of the printwheel relative to its rotatable drive shaft. The keyway is fabricated to establish, within desired tolerances, the precise location of the "home" position.

Another optical or magnetic home position sensor is taught in FIG. 5 of the aforementioned U.S. Pat. No. 4,209,262. Magnetically or optically readable indicia upon the printwheel may be accessed through an aperture in the loading cartridge, by a suitable magnetic or optical sensor. By use of this marking and detection method, the home position of the wheel may be sensed. In addition, this patent teaches that a predetermined pattern of similar indicia may be used to define a code to indicate the type of character font used.

The above-described mechanical arrangements for locating the printwheel at its home position are not foolproof as they require some degree of manual dexterity to manipulate the wheel relative to the carriage and drive shaft. On the other hand, the provision of a printwheel cartridge does result in a foolproof referenced mounting of the printwheel. However, it should be apparent that the cartridge approach is expensive, as it requires, in addition to the cartridge, a suitable receiving structure.

On its face, it would appear that the optical indicia and sensor approach to the dual problem of locating a reference position and identifying the printwheel characteristics appears to be quite satisfactory. However, the facts belie this conclusion. The impact printer environment generally becomes so dirty as to greatly interfere with correct optical sensing. This results from the fact that the paper record member is a bonded composite material made up of diverse particulate ingredients. These include: the bulk particles of small discrete cellulostic fibers of wood pulp, fillers such as clay, sizing such as rosin, coloring dyes, and bonding agents such as starches. When the paper is repeatedly impacted at high speeds and energy, clouds of particles are beaten off this composite material resulting in a contamination of the interior of the printer. Clearly, the particulates will detract from the effectiveness of the optical sensing devices and may even render them totally inoperative after a period of prolonged usage.

A further drawback of the sensed indicia approach resides in the increased manufacturing costs of the printwheel bearing the optical or magnetic indicia. Affixing the indicia, in the form of reflective stripes, requires integrally molding them or adhering them to the wheel by some other means. Both approaches are costly. Similarly, the use of magnetic indicia in conjunction with magnetic sensors also elevates the cost of the printwheel elements.

The novel rotary printing device of the present invention is provided with mounting means for coupling the printing device to a drive shaft, without regard to angular alignment, "home" position identifying means and characteristic identifying means, comprising two precisely located protrusions. In an alternative, more simple, form of the invention, the device only includes the "home" position identifying means. A foolproof method and apparatus for the in situ interpretion of both identifying means is also comprehended. Once mounted in the printer, on the drive shaft, the device is manipulated to locate the "home" reference position and to determine the included angle between the protrusions to "arm" the printer with location and characteristics information. In the case of a device of the alternative form, the manipulation will solely locate the "home" or reference position.

Many of the attendant advantages and the mode of operation of this invention will become more readily appreciated upon review of the following detailed description and with reference to the drawings, in which.

Figure 1:
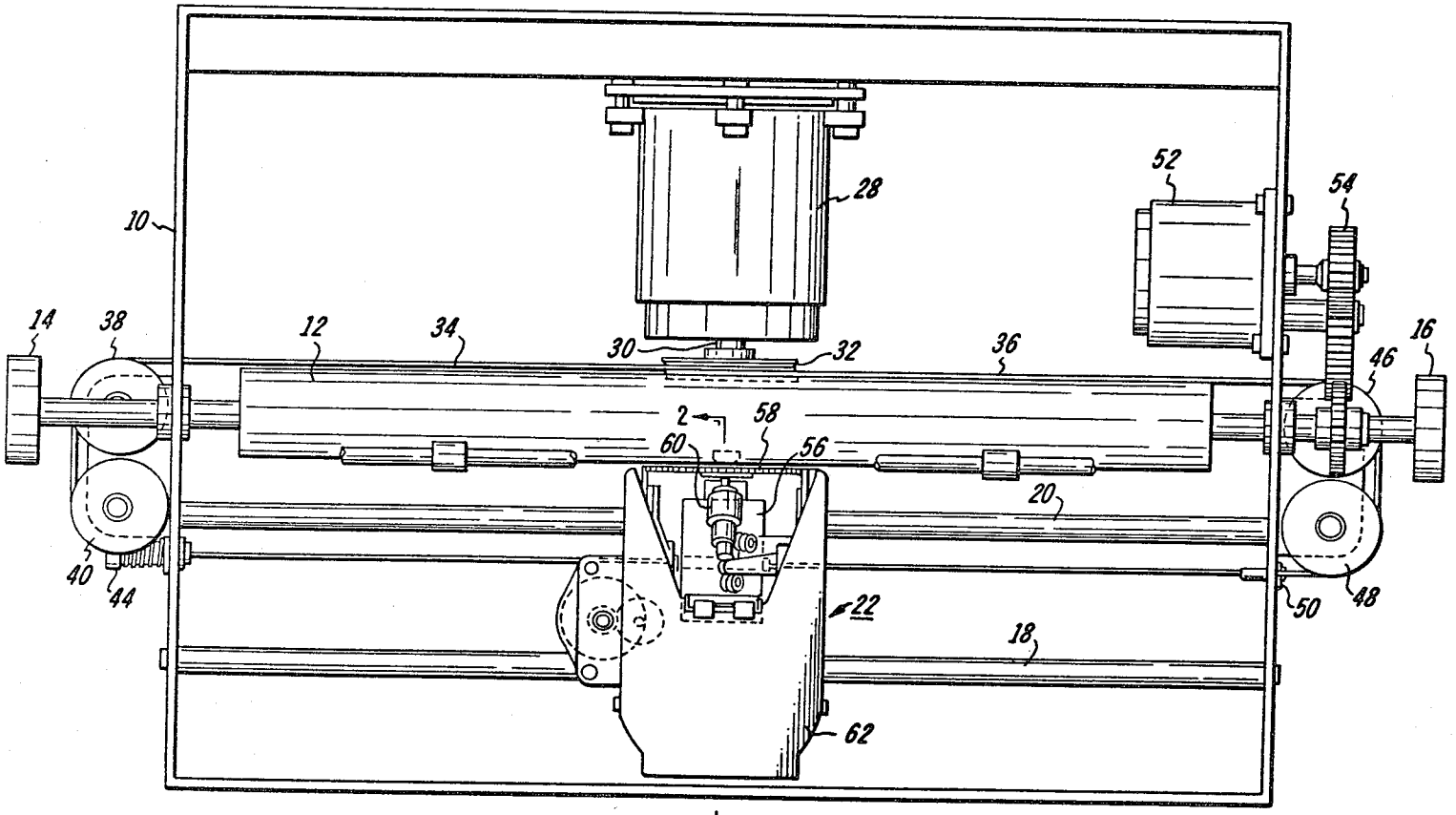
FIG. 1 is a plan view of a printer embodying the present invention.
Figure 2:
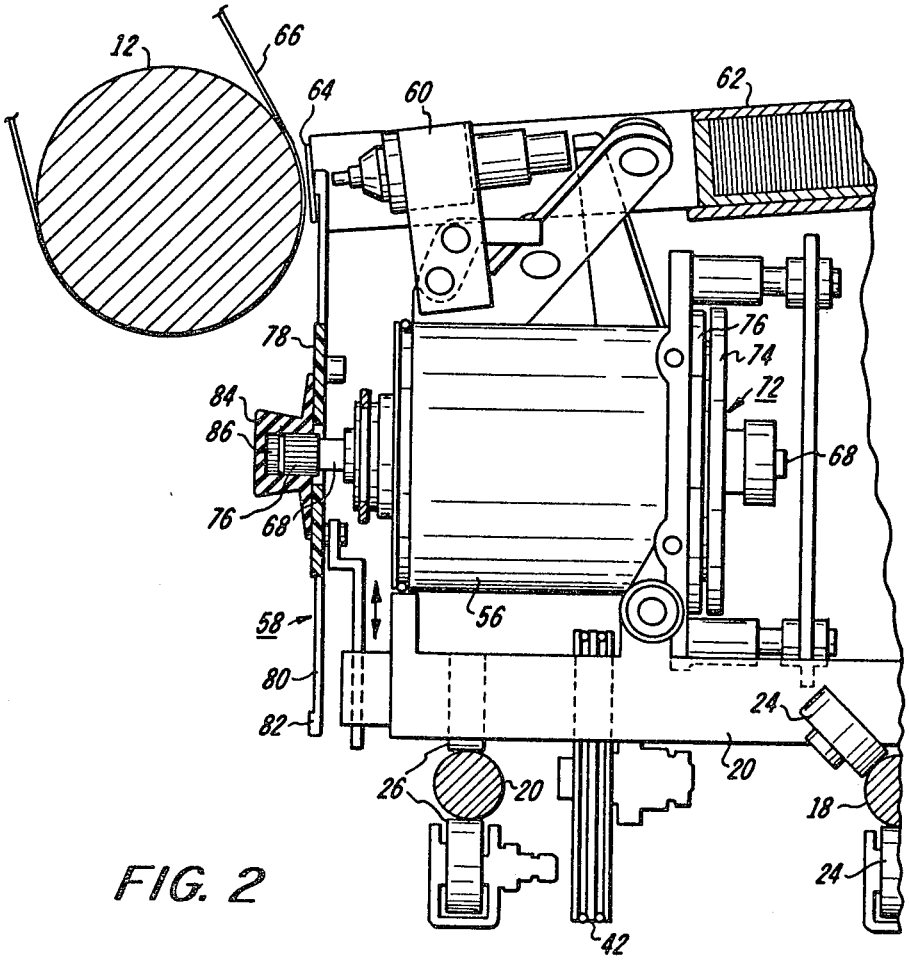
FIG. 2 is an enlarged cross-sectional view taken substantially along line 2—2 of FIG. 1.
Figure 4:
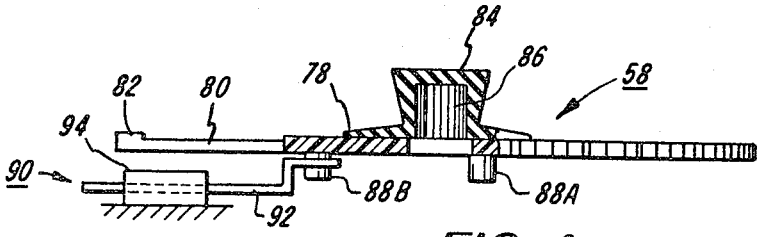
FIG. 4 is a side, partial sectional, view of the printing device of FIG. 3 showing the detector device in more detail.

Turning now, more specifically, to the drawings, there is illustrated in FIGS. 1 and 2 an overall view of a representative printer with which one form of the novel printing device of this invention may be used. The illustrated printer provides one suitable environment for supporting, rotating, sensing and impacting the device. It should be clear that the novel printing device of this invention may be in the form of a disk-shaped printwheel (as illustrated), a cup-shaped element (as referred to above), or any other suitable construction, and may be used in conjunction with any suitable impact printer mechanism.

External support for the printer is provided by rectangular frame 10 which carries a cylindrical platen 12 having end knobs 14 and 16 for manually rotating the platen to advance and retract a paper record member wrapped thereon. Spanning the long dimension of the frame 10 are smooth, parallelly aligned support rods 18 and 20 upon which carriage 22 is mounted for reciprocating linear movement from one end of the frame to the other end, on low friction roller assemblies 24 and 26.

The motive force for carriage 22 is provided by carriage motor 28 secured to frame 10 by suitable fastening members. The motor 28 has drive shaft 30 extending outwardly therefrom upon which is mounted a drive pulley 32, in the form of a capstan. Anchored to the pulley 32 are left cable segment 34 and right cable segment 36, each counterwound thereon. Cable segment 34 passes to idler pulleys 38 and 40, then over a portion of carriage pulley 42 (see FIG. 2) and is firmly secured to tensioning anchor 44 mounted upon the frame 10. Likewise, cable segment 36 passes to idler pulleys 46 and 48, over a portion of carriage pulley 42 (in the opposite direction) and has its end firmly secured to anchor 50 mounted upon the opposite frame wall. Accurate control of the energization of carriage motor 28, by the machine logic circuitry, enables the carriage to be moved incrementally, either to the left or to the right (as viewed in FIG. 1), by the desired amount and at the desired speed.

A paper feed motor 52, fixed to the right wall of frame 10 (as viewed in FIG. 1), drives the platen 12 through a gear train 54. Thus by controlling the motor 52 through the machine logic circuitry, paper may be advanced incrementally.

Mounted upon the reciprocable carriage 22, for lateral movement therewith, is a printwheel drive motor 56, to which is secured a printwheel 58, a hammer assembly 60, and a ribbon cartridge 62. Inked ribbon 64, stored within and advanced by the ribbon cartridge, is interposed between the printwheel type elements and the paper 66 wrapped upon platen 12.

The printwheel drive motor 56 has a central axial shaft 68 extending outwardly beyond the motor, both forwardly and rearwardly. The forward end of shaft 68 comprises a splined printwheel engaging and driving head 70 upon which the printwheel 58 may be mounted for being positively driven thereby. At the rearward end of shaft 68 there is located a transducer 72 including a rotatable disk 74, mounted upon and for rotation with shaft 68, and a fixed disk 76, secured to the motor housing. The transducer provides position signals representative of the rotational position of shaft 68 (and thus printwheel 58) to the printer control electronics in a known manner, as more specifically set forth in U.S. Pat. No. 3,839,665 entitled "Apparatus Measuring Relative Velocity of Movable Members Including Means to Detect Velocity from the Position Encoder", and U.S. Pat. No. 3,954,163 entitled "High Speed Printer With Intermittent Print Wheel And Carriage Movement", both by Andrew Gabor and assigned to the same assignee as the instant application.

There is illustrated in FIGS. 2–5 one form of the printwheel 58. It includes a central hub portion 78 from which a plurality of spokes 80 extend radially outwardly, each spoke terminating in a pad 82 upon which a character element is formed. The material of the printwheel is fabricated is of no import in the context of this invention. Preferably, it is molded of a suitable plastic material, however, heavy duty composite (i.e. plastic and metal combination) printwheels are also prevalent today and may be constructed to incorporate the instant invention. Typically, the printwheel includes a handling cap 84, secured to one side of the printwheel, and having a central cavity 86 in axial alignment with a central opening in hub 78. The cavity 86 is illustrated as being splined for receiving splined head 76 of drive shaft 68. Of course, any positive drive configuration may be used, such as a common square or hexagonal mating arrangement. In this manner, mounting and withdrawal of the printwheel from the shaft 68 is a simple and casual manual operation for the operator, since no attention need be paid to proper alignment of the printwheel, as heretofore required. It should be understood that cap 84 may be eliminated entirely, it being sufficient to provide the printwheel hub with some suitable mating arrangement for receiving the drive shaft.

Extending axially from the hub 78, are a pair of protrusions or identification pins 88A and 88B. Although the protrusions are illustrated as being of circular cross-section, it should be understood that they may be of any desired shape. They are preferably disposed on a common circle and are spaced from one another by a predetermined identification angle $\alpha$, which must be less than 180° (its complementary angle is designated as $\beta$). One of the pins (88A for the sake of this description), is the home position indicator. Dashed line "R", tangent to the pin 88A, will be the reference position from which the angular rotation to each of the characters is counted. The included angle $\alpha$, between the pins, will identify to the printer all the information necessary to properly operate that particular printwheel. Thus, once the angle has been determined, font style (viz. Pica, OCR, Emphasis), pitch (viz. 10, 12, PS) and font language (viz. French, German, English) will have been identified by the printer microprocessor and the location of each character and its required impact level will be known. All the foregoing information is simply and inexpensively integrated into the printwheel during fabrication, by the addition of the two protrusions or pins spaced from one another by a known angle. In the molded plastic wheels, provision may be made in the molding tool, for each different type of wheel, for including properly spaced protrusions. Since the protrusions are relatively small they will add little to the cost of the novel printwheel.

In order to obtain relevant information regarding the location of the pins and the included angle $\alpha$, a suitable detector device is required. One such detector embodiment 90 is disclosed in FIGS. 2 and 4. It includes a selectively moveable interposer 92 which may be moved by solenoid actuator 94 mounted upon carriage 22, or any other suitable device. When a printwheel is to be identified, such as, when a new wheel is loaded, or at the initiation of operation after power to the printer has been turned off, a detection cycle is effected. Since prudent practice dictates deenergizing the printer when the cover is opened for replacement of the printwheel, the detection cycle may be included in the usual power-up sequence.

A representative detection cycle may include the following steps: first, the printwheel drive motor 56 is energized to rotate the printwheel at a slow speed, i.e. less than one and one-half revolutions per second (as compared to its normal print speed, i.e. approximately five to fifteen revolutions per second); second, the interposer 92, of detector 90, is moved by means of the solenoid 94 into interference relationship with the pins 88A and 88B; third, the printwheel drive motor is stopped when one of the pins 88 contacts the interposer 92, stopping the drive motor and arresting the train of signals from the transducer; fourth, the direction of printwheel motor 56 is reversed and printwheel 58 will be slowly rotated until the other of the pins 88 contacts the interposer 92, again stopping the drive motor and arresting the train of signals from the transducer; and finally, the interposer is retracted by the solenoid 94. The angle between pins 88A and 88B can easily be ascertained by counting the number of transducer generated zero crossing signals transmitted during the reverse rotation of the printwheel motor. Rotation of the printwheel during the first step of the detection cycle (i.e. before introduction of the interposer 92) is effected to prevent jamming or locking of the drive motor, which could result if one of the pins were in direct alignment with the interposer at the time the solenoid actuator 94 is energized, and the interposer is urged against a pin. Of course, the drive motor and the interposer solenoid may be energized simultaneously rather than sequentially, as set forth above.

Figure 3:
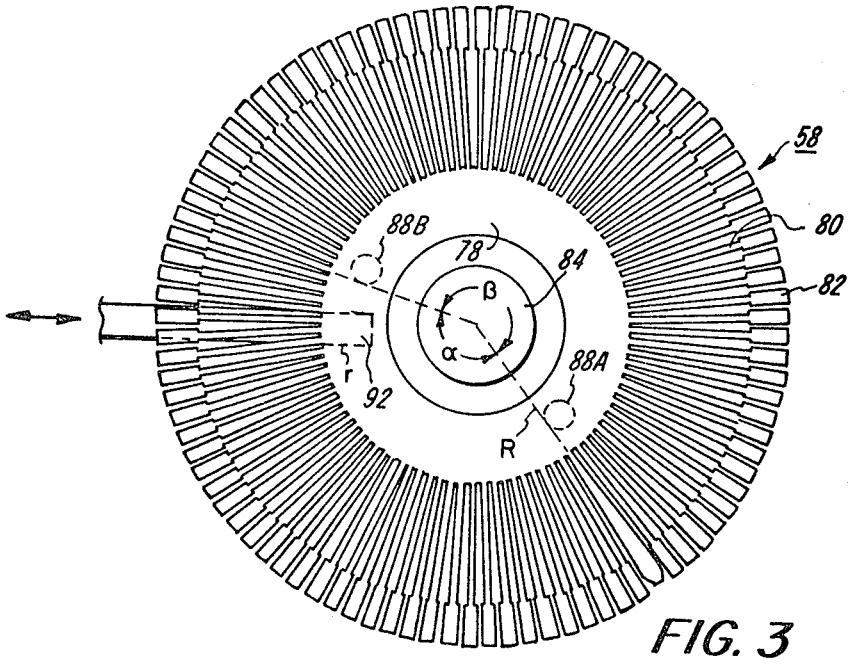
FIG. 3 is an enlarged plan view of the novel printing device of this invention, showing a detector device in the angle $\alpha$ zone.
Figure 5:
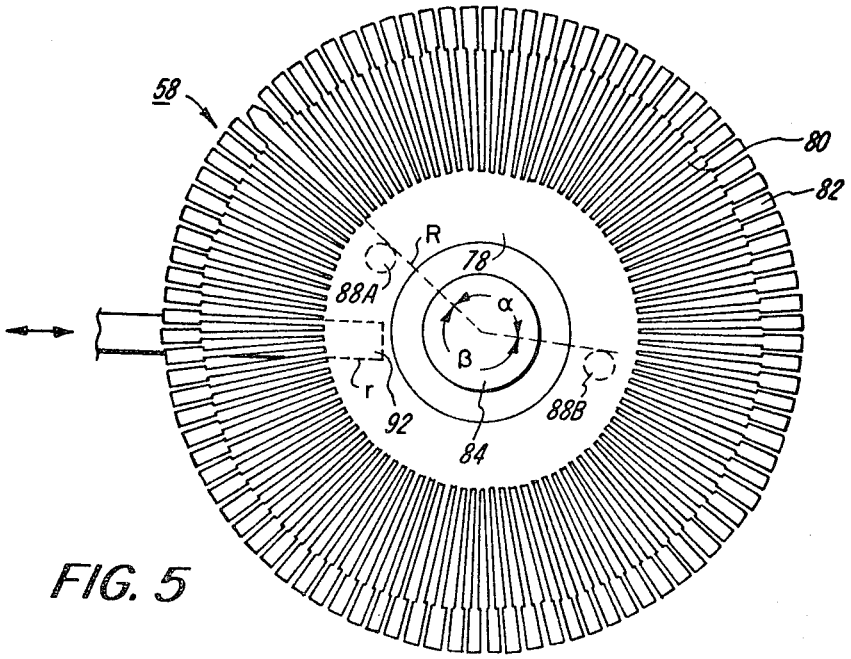
FIG. 5 is an enlarged plan view of the novel printing device of this invention, showing a detector device in the angle $\beta$ zone.

As stated above, the printwheel 58 may be mounted upon the shaft 68 without regard to aligning it at a home position. Thus, as illustrated in FIGS. 3 and 5, the interposer may measure either the angle $\alpha$ or the angle $\beta$. For the purposes of this invention, it is of no import which angle is measured since the printer control electronics is programmed to identify an angle between 0° and 180°. In the event that an angle greater than 180° is measured, that angle is merely subtracted from 360° to determine the printwheel characteristic identification angle. Alternatively, the printer control electronics may be programmed to generate the same output identification for the $\alpha$ or $\beta$ angle.

The printwheel "home" or reference position ("R") may be arbitrarily selected to be adjacent to pin 88A in the $\alpha$ zone. Therefore, it is determined by the juxtaposition of wall "r" of interposer 92 and pin 88A. Clearly, if the measured angle is $\beta$, the opposite walls of interposer 92 and pin 88A will be in contact, thus, the printer control electronics must also be programmed to compensate for the pin and interposer dimensions, to correctly determine the angle $\alpha$ and to locate the home position, in the event that angle $\beta$ is measured.

Another embodiment of the detector device and detection cycle will now be described (but will not be illustrated in the drawings). In this form, a detector, including a fixed interposer, is mounted on the left frame element (as viewed in FIG. 1) adjacent a carriage stop, also mounted upon the left frame element. At the initiation of the powerup sequence, the carriage will be moved fully to the left until it abuts the stop. Prior to contacting the stop, the printwheel drive motor will begin to rotate the wheel at the slow detection speed. Thus, when the carriage arrives at the stop, the interposer will be in a position to interfere with the free rotation of the printwheel, but because of the premature rotation, the drive motor will not jam, if they happen to be in direct alignment. The subsequent detection cycle steps as set forth above may then be carried out, namely, the printwheel is rotated in a first direction until it hits one of the pins, then the printwheel is rotated in the opposite direction until it is again stopped by the other pin. The measured angle $\alpha$ or $\beta$ is determined and the printer control electronics is armed with all the information necessary for proper utilization of the new printwheel. As it is sometimes required to change printwheels during the production of a task, it is desireable, with this embodiment, that the printer control electronics restore the carriage to its previous location relative to the platen (and document) after the printwheel has been identified, so that the task may be completed.

Figure 6:
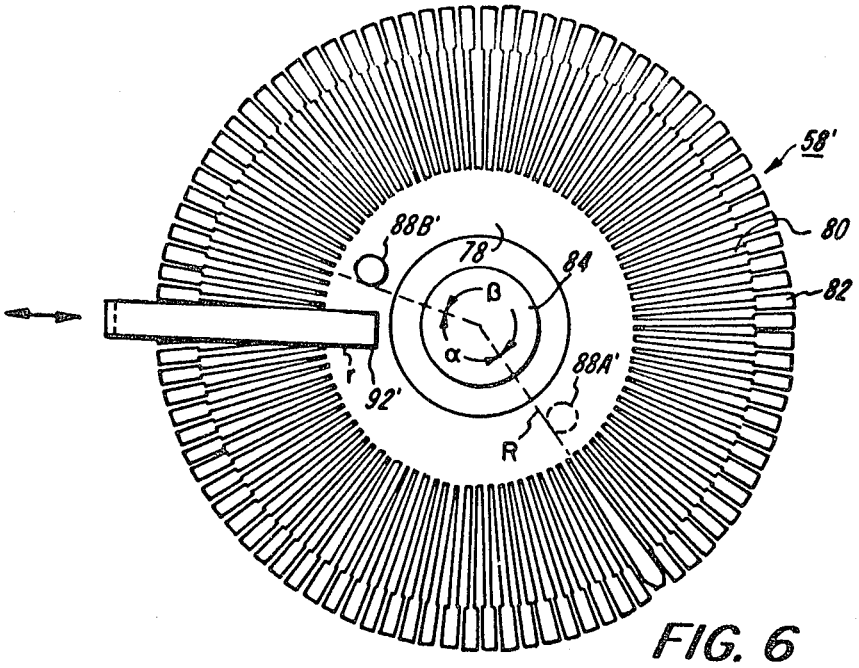
FIG. 6 is an enlarged plan view of an alternative embodiment of the novel printing device of this invention, showing identification protrusions on both sides.
Figure 7:
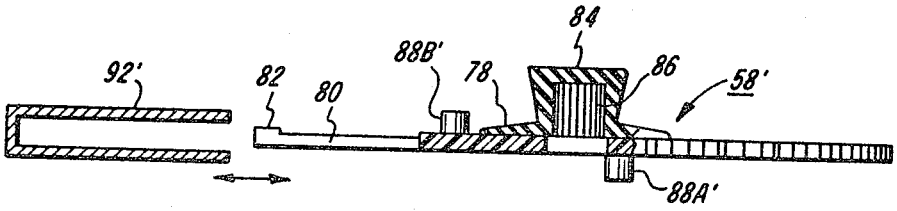
FIG. 7 is a side, partial sectional, view of the printing device of FIG. 6 showing the detector device in more detail.

An alternative embodiment of the unique printing device is identified as 58' in FIGS. 6 and 7 wherein the protrusions 88A' and 88B' are on opposite sides of the printwheel and the interposer 92' is in the form of a U-shaped element. It is contemplated that this form of the printing device be utilized with the detector device and detection cycle described in the preceding paragraph, wherein the interposer 92' is fixed on the printer frame and the printwheel carriage is brought into interference relationship with the interposer during the detection cycle. It should be apparent that this embodiment will only be practical with a disk-shaped printing device.

Figure 8:
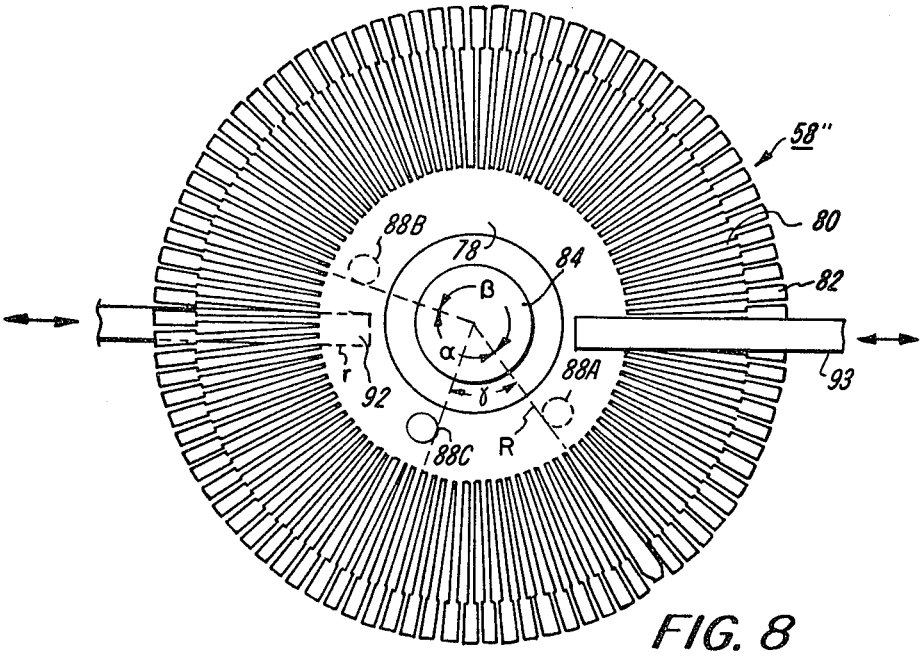
FIG. 8 is an enlarged plan view of another embodiment of the novel printing device of this invention, showing three identification protrusions.

As it becomes desirable to identify a larger number of printing devices than can be determined from the 180° region allotted to identification, as described above, a further embodiment of the printing device is suggested. By providing the printwheel 58'' illustrated in FIG. 8, having protrusions 88A and 88B on one side (as in FIG. 3) and a third protrusion 88C located on the opposite side, a further identification region of substantially 360° becomes possible. The identification region, defined by the angle $\gamma$ between protrusion 88C and reference position ("R"), may be measured by a second interposer 93 moved into interference relationship with the protrusion 88C at the appropriate time. While the interposer 93 has been shown in FIG. 8 at the 3 o'clock position, it should be understood that it may be mounted in any advantageous location as long as it is able to perform its desired function. The method of in situ identification will follow the series of steps set forth above, with respect to the FIG. 3 embodiment, with the addition of the further steps of removing interposer 92, rotating the printwheel at the slow speed, and moving the interposer 93 into interference position. Since the printer electronics would have already determined the location of the reference position it is a simple matter to measure the angle (up to 360°) between that position and the third protrusion, in either direction. Therefore, it is a matter of choice to rotate the printwheel in the first direction or in the second direction.

Figure 9:
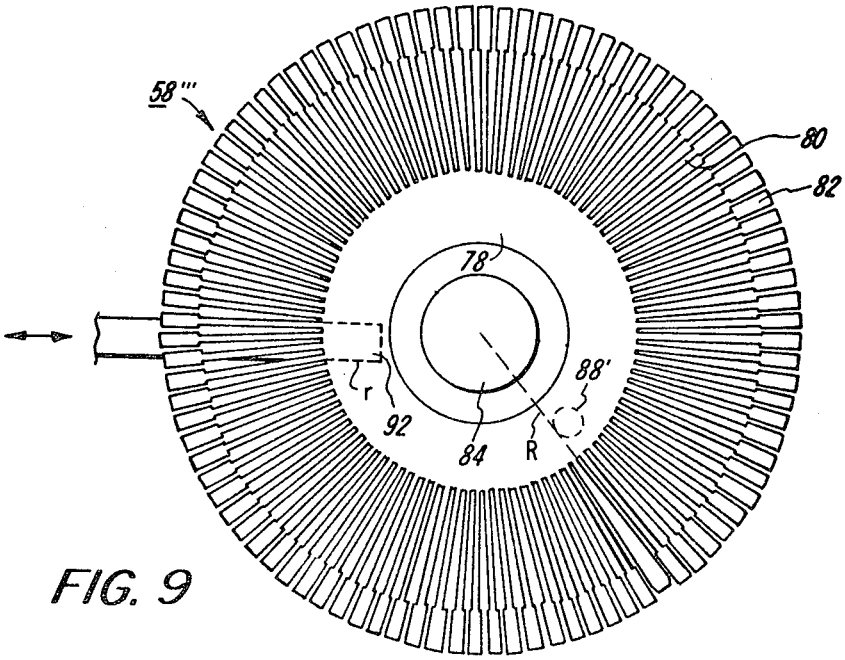
FIG. 9 is an enlarged plan view of yet another embodiment of the novel printing device of this invention, showing a single identification protrusion.

Although the novel rotary printing device of the present invention has been described as being provided with means for identifying a "home" position and for identifying the printing device characteristics, the present invention also contemplates a printing device provided solely with "home" position identifying means. Such a device is illustrated in FIG. 9, as 58'', and is provided with a single protrusion 88. In use, the printer will rotate the printing device in one direction only, until the moveable interposer 92 abuts the protrusion 88 and stops the drive motor. When this ocurs, the reference position "R" has been determined and the printer control electronics will be "armed".

Figure 10:
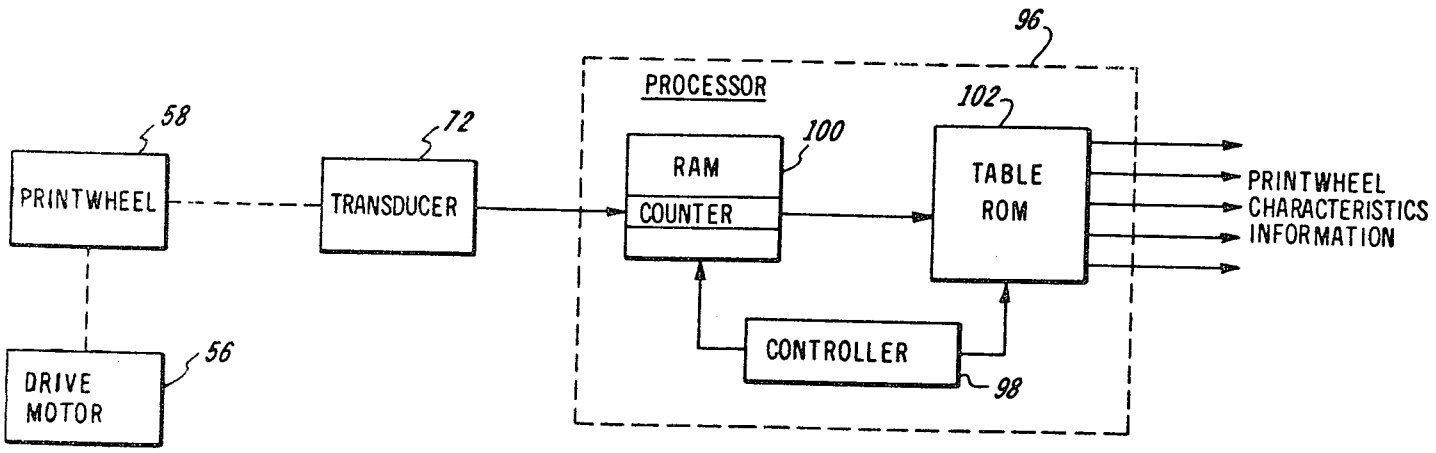
FIG. 10 is a schematic block diagram showing the printer control electronics.

Reference is now made to FIG. 10 for a graphic representation of the printer control electronics capable of carrying out the in situ identification of the embodiment illustrated in FIGS. 1 through 5. During the identification cycle, as described above, the printwheel drive motor 56 rotates the printwheel 58 relative to the interfering interposer 92. Each time one of the printwheel protrusions 88 contacts the interposer, the printwheel and its drive motor will be stopped. The transducer 72, also carried on the shaft of the drive motor 56, generates a cyclical signal, as the drive shaft rotates, whose cycles are sensed by the processor 96 as an indication of a predetermined incremental rotation of the printwheel. The processor 96 may be similar to the processor 76 disclosed in U.S. Pat. No. 4,058,195 by Fravel et al (assigned to the same assignee as the instant invention) and found in the HyType II serial printer manufactured by Diablo Systems, Inc. of Hayward, Calif.

The cyclical signal train is used by the control elements of the processor 96, referred to generally as the controller 98 to increment a counter defined in a storage location of a random access memory (RAM) 100, within the processor 96. The counter will be reset by the controller, during the identification cycle, upon the first incidence of arrested movement of the drive motor, indicating that the first protrusion has been contacted. Continued rotation of the drive motor will again allow the transducer to generate cyclical position signals. Each cycle is then counted by the RAM counter until the second incidence of arrested movement stops the train of signals, at which time the counter is also stopped by the controller. The value stored in the RAM counter indicates the number of cycles, of the cyclical signal train, between protrusions 88A and 88B. Then, the stored value is applied as an address to a table read-only memory (ROM) 102 which contains all the characterizing data for each printwheel to be used with the printer. It should be noted, that the table ROM will also be programmed to generate the same characterizing data for a stored RAM value indicative of the $\alpha$ angle or $\beta$ angle. Each of the other alternative embodiments, of the present invention, described above will require a similar identification cycle control program.

It is to be understood that the present disclosure of an improved printwheel and the method of its use has been made only by way of example, and that numerous changes in process steps, details of construction and the combination and arrangement of parts may be resorted to without departing from the true spirit and scope of the invention as hereinafter claimed.

What is claimed is:

1. A rotary printing device for an impact printer; said printer including a rotatable drive shaft for supporting said printing device for rotation about its axis and interposer means for relative movement into and out of interfering relationship with said printing device; said printing device including a central hub, mounting means on said hub for securing said printing device to said drive shaft, and a plurality of spokes, extending outwardly from said central hub, terminating in character pads, said printing device being characterized by comprising first and second blocking means, extending axially outwardly from said hub, for contacting said interposer means when said interposer means is positioned in interfering relationship with said printing device, said blocking means subtending an identification angle therebetween, about the axis of said printing device, said identification angle being selected to uniquely identify the characteristics of said printing device and to distinguish said printing device from others having different characteristics.

2. The rotary printing device as defined in claim 1 wherein said mounting means is formed to allow said printing device to be coupled with a drive shaft independently of any predetermined angular position and wherein one of said blocking means additionally identifies a reference position.

3. The rotary printing device as defined in claim 1 wherein one of said blocking means extends axially outwardly from one side thereof and another of said blocking means extends axially outwardly from the opposite side thereof.

4. The rotary printing device as defined in claim 1 wherein one of said protrusions extends axially outwardly from one side thereof and the other of said protrusions extends axially outwardly from the other side thereof.

5. The rotary printing device as defined in claim 2 further including a third blocking means, and wherein said first and second blocking means extend axially outwardly from one side thereof and said third blocking means extends axially outwardly from the opposite side thereof, and wherein one of said first and second blocking means identifies a reference position, and wherein the included angle, about said printing device axis, between said reference position and said third blocking means uniquely identifies the characteristics of said printing device.

6. The rotary printing device as defined in claim 1 wherein said identification angle is less than 180°.

7. The rotary printing device as defined in claim 2 wherein said device is disk-shaped.

8. A method for the in situ identification of a rotary printing device mounted upon a carriage in an impact printer, wherein the printing device includes identification protrusions extending axially outwardly therefrom, wherein the angle between the protrusions, about the printing device axis, identifies the print element characteristics, comprising the steps of:

coupling the printing device to the drive shaft of a drive motor mounted on the carriage, energizing the drive motor to cause the drive shaft to rotate in a first direction, generating a signal train in response to the angular movement of the drive shaft, introducing interposer means into the space between the protrusions, arresting the movement of the drive motor when the first protrusion contacts the interposer means, detecting the first incidence of arrested movement, generating a first identification value indicative of the first arrest position, reversing the direction of rotation of the drive motor, arresting the movement of the drive motor when the second protrusion contacts the interposer means, detecting the second incidence of arrested movement, generating a second identification value indicative of the second incidence of arrested movement, and identifying the printing device characteristics in response to the difference between the first and second identification values.

9. The method for in situ identification of a rotary printing device as defined in claim 8 wherein one of the protrusions is a reference element and further including the step of identifying the location of the printing device reference position from the first and second identification values.

10. The method for in situ identification of a rotary printing device as defined in claim 9 comprising driving the printing device drive motor in said first and reverse directions at a rate of speed slower than the speeds attained while printing.

11. The method for in situ identification of a rotary printing device as defined in claim 10 wherein the printing device drive motor is driven in said first and reverse directions at less than one and one-half revolutions per second.

12. The method for in situ identification of a rotary printing device as defined in claim 8 wherein the interposer means is mounted upon the carriage and said step of introducing the interposer means into the space between the protrusions includes moving the interposer means from a first position, normally out of interference relation with the protrusions, to a second position, in interference relation with the protrusions.

13. The method for in situ identification of a rotary printing device as defined in claim 8 wherein the interposer means is mounted upon one wall of the frame of the printer and the step of introducing the interposer means into the space between the protrusions includes moving the carriage towards the one wall to a position where the interposer means is in interference relation with the protrusions.

14. The method for in situ identification of a rotary printing device as defined in claim 9 further including determining the angle between the protrusions in response to the difference between the first and second identification values, and wherein, if the angle is determined to be less than 180°, locating the printing device reference position at the printing device radius passing through the point of contact between the interposer and one of the protrusions, and if the angle is determined to be greater than 180°, locating the printing device reference position at the printing device radius passing through the tangent diametrically remote from the point of contact between the interposer and the one of the protrusions.

15. The method for in situ identification of rotary printing device as defined in claim 9 wherein the interposer means is mounted upon the carriage and said step of introducing the interposer means into the space between the protrusions includes moving the interposer means from a first position, normally out of interference relation with the protrusions, to a second position, in interference relation with the protrusions.

16. The method for in situ identification of a rotary printing device as defined in claim 9 wherein the interposer means is mounted upon one wall of the frame of the printer and the step of introducing the interposer means into the space between the protrusions includes moving the carriage towards the one wall to a position where the interposer means is in interference relation with the protrusions.

17. Apparatus for the in situ identification of a rotary printing device upon a carriage in an impact printer, wherein the printing device includes a pair of identification protrusions extending axially outwardly therefrom and the angle between the protrusions identifies its characteristics, comprising:

coupling means for mounting said printing device on the drive shaft of a drive motor mounting on said carriage, means for energizing said drive motor for rotating said drive shaft, interposer means moveable into the space between said protrusions and in interference relation therewith for arresting the movement of said drive motor when said protrusions make contact therewith, means for generating a signal indicative of the incremental angular movement of said drive motor, means for detecting the first incidence of arrested movement of said drive motor when said first protrusion contacts said interposer and for detecting the second incidence of arrested movement of said drive motor when said second protrusion contacts said interposer, means for storing information representative of the angular distance between said protrusions, and means for identifying the printing device characteristics in response to said stored information.

18. The apparatus for the in situ identification of a rotary printing device as defined in claim 17 wherein said coupling means allows said printing device to be mounted upon said drive shaft independently of any predetermined angular position.

19. The apparatus for the in situ identification of a rotary printing device as defined in claim 17 wherein said means for energizing said drive motor is reversible for rotating said drive shaft in one direction until said interposer contacts one of said protrusions and for rotating said drive shaft in the reverse direction until said interposer contacts the other one of said protrusions.

20. The apparatus for the in situ identification of a rotary printing device as defined in claim 17 wherein said interposer means is mounted upon said carriage and there is provided actuator means for moving said interposer means from a first position, normally out of interference relation with the protrusions, to a second position, in interference relation with the protrusions.

21. The apparatus for the in situ identification of a rotary printing device as defined in claim 15 wherein said means for energizing said drive motor is reversible for rotating said drive shaft in one direction until said interposer contacts one of said protrusions and for rotating said drive shaft in the reverse direction until said interposer contacts the other one of said protrusions.

22. The apparatus for the in situ identification of a rotary printing device as defined in claim 15 wherein said interposer means is mounted upon said carriage and there is provided actuator means for moving said interposer means from a first position, normally out of interference relation with the protrusions, to a second position, in interference relation with the protrusions.

* * * * *